US009854837B2

(12) United States Patent
Leger

(10) Patent No.: US 9,854,837 B2
(45) Date of Patent: Jan. 2, 2018

(54) SUBSTITUTE CIGARETTE FOR NON-COMBUSTION USE

(71) Applicants: Lynn Edward Hartrick, Shemogue (CA); Joseph Raymond Leger, Shemogue (CA)

(72) Inventor: Joseph Raymond Leger, Shemogue (CA)

(73) Assignees: Lynn Edward Hartrick, Shemogue, N.B. (CA); Joseph Raymond Leger, Shemogue, N.B. (CA)

( * ) Notice: Subject to any disclaimer, the term of this patent is extended or adjusted under 35 U.S.C. 154(b) by 246 days.

(21) Appl. No.: 14/674,031

(22) Filed: Mar. 31, 2015

(65) Prior Publication Data

US 2015/0296881 A1 Oct. 22, 2015

Related U.S. Application Data

(60) Provisional application No. 61/980,126, filed on Apr. 16, 2014.

(51) Int. Cl.

| | |
|---|---|
| ***A24F 47/00*** | (2006.01) |
| ***A24F 15/00*** | (2006.01) |
| ***A24D 1/00*** | (2006.01) |
| ***B65B 19/02*** | (2006.01) |
| ***B65B 61/00*** | (2006.01) |

(52) U.S. Cl.

CPC ..... *A24F 47/002* (2013.01); *A24D 1/002* (2013.01); *A24F 15/00* (2013.01); *B65B 19/02* (2013.01); *B65B 61/00* (2013.01)

(58) Field of Classification Search

CPC ..... A24F 47/00; A24F 47/02

See application file for complete search history.

(56) References Cited

U.S. PATENT DOCUMENTS

| | | | | |
|---|---|---|---|---|
| 4,807,648 | A * | 2/1989 | Breckwoldt | A24F 47/002 131/359 |
| 5,167,244 | A * | 12/1992 | Kjerstad | A23G 3/368 131/352 |
| 5,799,663 | A * | 9/1998 | Gross | A24F 47/002 131/270 |
| 6,041,789 | A | 3/2000 | Bankert et al. | |
| 2009/0139533 | A1* | 6/2009 | Park | A24B 15/16 131/274 |
| 2010/0294288 | A1* | 11/2010 | Sampson | A24D 3/0212 131/274 |

(Continued)

*Primary Examiner* — Eric Yaary

(74) *Attorney, Agent, or Firm* — Ryan W. Dupuis; Kyle R. Satterthwaite; Ade & Company Inc.

(57) ABSTRACT

A non-combusting cigarette substitute device has an elongated tubular casing occupied by a filter portion of a first porous material in proximity to a first end and a substitute portion of a second porous material spanning between the filter portion and an opposing second end. The second porous material has a density which is greater than a density of the first porous material. Overall, the densities of the first and second porous materials are suitable to readily permit air to be drawn through the tubular casing in response to suction supplied by a user to imitate the draw of a conventional cigarette. A flavouring agent is applied in an effective amount to the device such that vapors released from the flavouring agent impart a taste to the air drawn through the tubular casing.

17 Claims, 2 Drawing Sheets

(56) References Cited

U.S. PATENT DOCUMENTS

| | | | | |
|---|---|---|---|---|
| 2012/0255569 | A1* | 10/2012 | Beard | A24D 3/04<br>131/334 |
| 2013/0025611 | A1* | 1/2013 | Rushforth | A24D 3/10<br>131/332 |
| 2015/0000592 | A1* | 1/2015 | Schnakenberg | A24C 5/005<br>118/712 |

* cited by examiner

SUBSTITUTE CIGARETTE FOR NON-COMBUSTION USE

This application claims the benefit under 35 U.S.C.119(e) of U.S. provisional application Serial No. 61/980,126, filed Apr. 16, 2014.

FIELD OF THE INVENTION

The present invention relates to a cigarette substitute device comprising a tubular casing including porous material therein and a flavouring agent arranged to impart a taste to air drawn through the tubular casing responsive to suction supplied by a user without any combustion of the device.

BACKGROUND

Smoking in North America has declined dramatically over the past two decades. In Canada the industry has stabilized with the market growth of 1.9% in 2014. Today millions of people smoke around the world.

Smokers are subject to a host of pressure outlining the evils of smoking and its effect on the individuals' health. Governments continue to put in place more taxes on the products, more communications, restrictions and more legal suits against big tobacco. Big tobacco sees the writing on the wall, more social pressure, more suits, greater numbers of businesses banning smoking. The big companies are now investing in healthier products that allow smokers to get their fix without breaking any rules or upsetting people around them. Smaller companies are creating smokeless cigarettes designed to cater to smoker's habits but also assist in quitting smoking.

Blends of herbal remedies are hitting the market and starting another wave of smoking cessation while still giving smokers an alternative. Smokeless cigarettes are on the rise and here to stay.

U.S. Pat. No. 6,041,789 by Bankert et al discloses a non-pyrolytic cigarette substitute device which, in response to suction supplied by a user, delivers to the user a nicotine-simulating vapor mixture having a cigarette-like taste and aroma. The device has absorbed therein a solution of a volatile nicotinomimetic agonist in an amount effective for its released vapors to satisfy the physiological needs for nicotine of the user, and volatile palatability enhancing agents in amounts effective for their released vapors to neutralize any unpleasant taste and aroma of the nicotinomimetic agonist vapors and to impart a cigarette-like taste and aroma to the released vapor mixture. The cigarette substitute device is concerned primarily with providing the user with a nicotine substitute together with flavouring arranged to simulate an actual cigarette taste. Little or no attention is directed towards simulating the draw of an actual cigarette to satisfy the habitual feeling of a user drawing on an actual cigarette.

SUMMARY OF THE INVENTION

According to one aspect of the invention there is provided a cigarette substitute device for non-combustion use, the device comprising:

an elongated tubular casing extending in a longitudinal direction between a first end and a second end of the device;

a filter portion comprising a first porous material occupying the tubular casing in proximity to the first end;

a substitute portion comprising a second porous material fully occupying the tubular casing between the filter portion and the second end; and a flavouring agent which is arranged to release vapors;

the second porous material having a density which is greater than a density of the first porous material;

the densities of the first and second porous materials being suitable to readily permit air to be drawn through the tubular casing in response to suction supplied by a user;

the flavouring agent being applied in an effective amount to the device such that vapors released from the flavouring agent impart a taste to said air drawn through the tubular casing.

The arrangement of the densities of the porous materials allows the cigarette substitute device to better simulate the draw of an actual cigarette. Preferably the densities of the first and second porous materials are selected such that an overall pressure drop in air drawn through the tubular casing in response to suction supplied by a user is between 100 and 300 millimeters of water. For example, in the instance of the first and second porous materials each comprising cellulose acetate, the first porous material may have a denier of approximately 3.0 per filament with a total denier of approximately 30,000, and the second porous material may have a denier of greater than 4.0, or more preferably approximately 5.0, with a total denier of greater than 30,000, or more preferably approximately 39,000.

The second porous material may be coloured so as to be representative of combusting tobacco.

The tubular casing preferably includes a tipping paper wrapped about the filter portion which includes a consumable confection coating thereon.

Preferably the flavoring agent is evenly dispersed throughout the filter materials.

When provided in combination with a plurality of other cigarette substitute devices identical in configuration to one another and packaging materials receiving the plurality of cigarette substitute devices therein, preferably a flavoring agent is applied to an interior surface of the packaging materials so as to be arranged to impart flavoring to the plurality of cigarette substitute devices.

Preferably the packaging materials include a foil wrapper having a paper lining defining said interior surface such that the flavoring agent is applied to the paper lining.

The first porous material of the filter portion and the second porous material of the substitute portion may comprise crimped paper in some embodiments.

According to a second aspect of the present invention there is provided a cigarette substitute package comprising:

a plurality of substitute cigarette devices, each device comprising an elongated tubular casing and a porous material occupying the tubular casing;

a package receiving the plurality of cigarette substitute devices therein;

a flavoring agent applied to an interior surface of the package in an effective amount so as to be arranged to impart flavoring to the plurality of cigarette substitute devices within the package.

According to a third aspect of the present invention there is provided a method of package a plurality of cigarette substitute devices, the method comprising:

providing a plurality of substitute cigarette devices comprising an elongated tubular casing and a porous material occupying the tubular casing;

providing a package arranged to receive the plurality of cigarette substitute devices therein;

applying a flavoring agent to an interior surface of the package in an effective amount which is arranged to impart flavoring to any cigarette substitute devices received within the package; and inserting the plurality of cigarette substitute devices into the package.

Preferably the flavoring agent applied to the interior surface of the package is the only flavoring agent imparted to the cigarette substitute devices.

The cigarette substitute device works with the daily routine of a smoker by substituting a smokeless product for the real thing giving the smoker the sensation of smoking in a healthy way. According the cigarette substitute device provides an alternative that may assist in cutting down consumption of real cigarettes. Benefits of the cigarette substitute as compared to other cigarettes and other varieties of cigarette substitutes include the following: No odor; Healthy alternative; No accessories; Usage indoors business offices; More economical; Last longer; Less addicting; Cleaner little waste; Hip; and they May help you quit.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
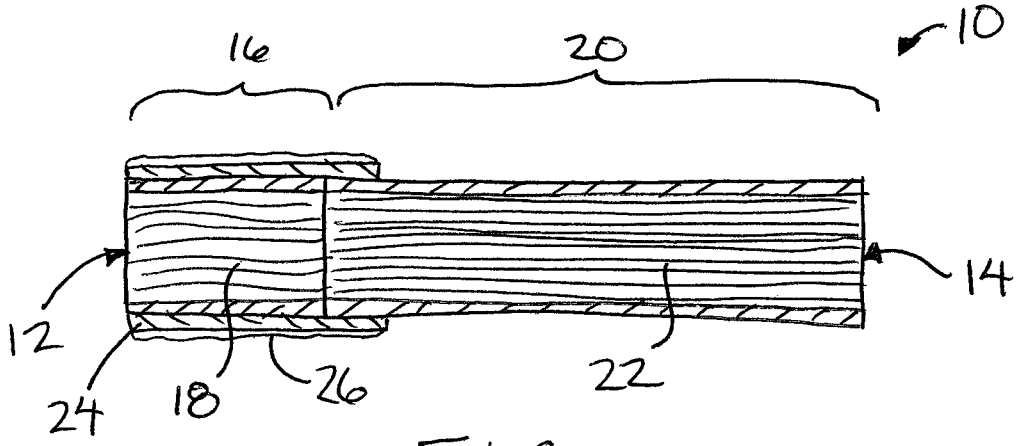
FIG. 1 is a sectional view of the substitute cigarette device.
Figure 2:
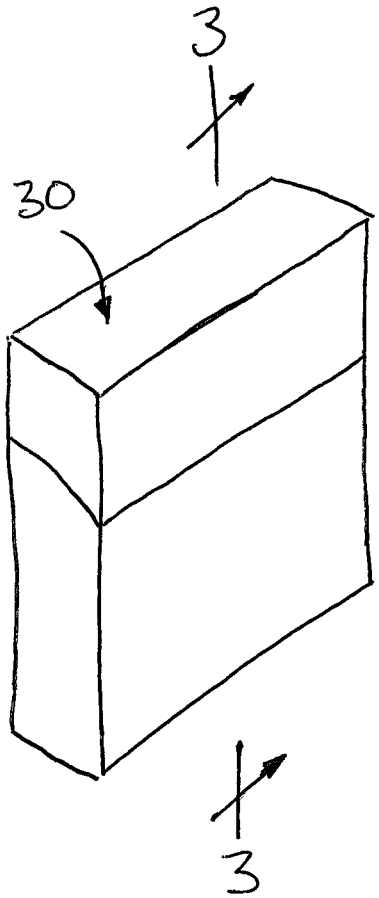
FIG. 2 is a perspective view of a package containing a plurality of substitute cigarette devices therein.
Figure 3:
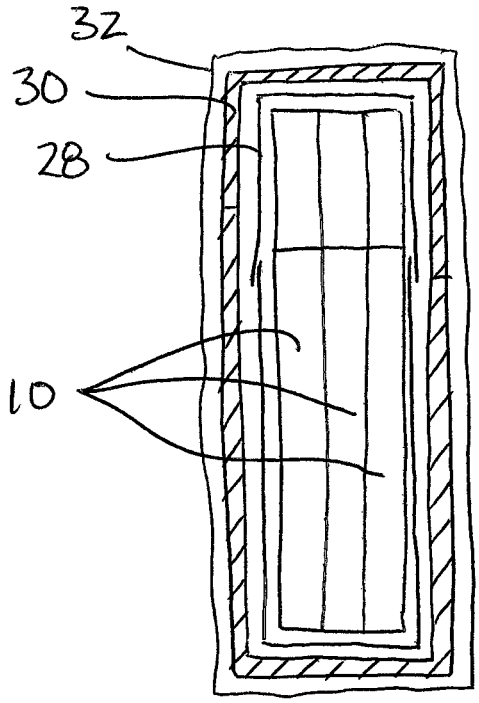
FIG. 3 is a sectional view along the line 3-3 of FIG. 2.

Referring to the accompanying figures, there is illustrated a substitute cigarette device generally indicated by reference numeral 10. The device 10 is particularly suited for use instead of a conventional tobacco cigarette. Use of the device involves a user drawing air through the device by applying suction to one end without any combustion taking place.

The device 10 generally includes an elongate tubular casing which extends in a longitudinal direction between a first end 12 and an opposing second end 14. The casing includes a filter portion 16 immediate adjacent the first end for extending partway towards the second end. The filter portion of the casing is fully occupied by a first porous material 18 as described in further detail below.

The casing further includes a substitute portion 20 which spans longitudinally between the filter portion and the opposing second end of the device. The substitute portion of the casing is fully occupied by a second porous material 22 which fully spans the length of the substitute portion.

The two portions of the casing with the respective porous materials therein are formed independently with one another and then joined in a tipping operation similar to the mounting of a filter tip to a rod of tobacco when assembling a conventional cigarette. Accordingly, a strip of tipping paper 24 is used to extend about the filter portion of the casing in which the tipping paper has a length in the longitudinal direction which is greater than the filter portion for partially overlapping the inner end of the substitute portion to join the two portions together.

A consumable confection coating 26 is provided on the tipping paper 24 at the outer surface thereof. The coating is sweet and is arranged to be consumed by contact with the lips of a user when applying suction to the first end of the substitute cigarette device.

The devices have an overall size, shape and appearance which is substantially identical to a conventional cigarette with the packaging being similar to cigarettes as well. Accordingly, the substitute cigarette devices 10 are packaged in groups of 20 which include inner packaging material in the form of a foil wrap 28 surrounding the bundle of cigarette devices 10 and an outer package 30 formed of light-weight cardboard material. The foil wrapper 28 is similar to the wrappers used in packaging conventional cigarettes such that there is an outer foil layer and a paper lining on an inner surface thereof.

A natural flavoring agent is applied to the paper lining of the foil wrapper 28 so as to be positioned in close proximity to the substitute cigarette devices once packaged. The flavoring agent is volatile so as to be arranged to release vapors therefrom. No other flavoring agent is applied directly to the devices other than the flavoring agent applied to the inner surface of the foil wrap 28 which has been found to be sufficient for imparting sufficient flavoring agent which migrates for even distribution to the porous material of the cigarette devices subsequent to packaging as described in further detail below.

The outer package 30 generally comprises a rectangular cardboard package having a hinged lid portion for ready access to the substitute cigarette devices therein. A polypropylene external wrapper 32 then surrounds the outer package 30 to prevent the volatile flavoring agent from escaping the package prior to initiation of consumption by the user. The packages 30 are subsequently bundled in groups of 10 within respective cartons, with cartons being subsequently packaged within respective cases similar to the packaging of conventional cigarettes. As shown in the accompanying figures and described herein, the plurality of cigarette substitute devices are supported in parallel to one another in a bundle within the outer package such that a length of the cigarette substitute devices in the longitudinal direction between the first and second ends thereof fully occupy a corresponding interior length of the outer package.

In a preferred embodiment, the first and second porous materials of the substitute cigarette device both comprise cellulose acetate. The cellulose acetate is presented in the form of a plurality of elongate filaments extending in the longitudinal direction of the device and which are bunched together to fully occupy the volume within the tubular casing. Within the filter portion 16, the first porous material 18 is arranged to have a density and draw comparable to a conventional cigarette filter. Accordingly, a denier of approximately 3.0 per filament is used in the filter portion with the total denier being approximately 30,000. In the substitute portion, the second porous material 22 is provided with a denier of 5.0 per filament corresponding to a total denier of 39,000.

In other embodiments, the porous material may comprise crimped crepe paper similar to that which has been used in the prior art to form cigarette filters. In this instance, the density between the filter portion and substitute portion would again be different from one another to ensure an optimal draw through the overall substitute cigarette device which is comparable to a conventional tobacco cigarette.

Regardless of the type of porous material used, in either instance, the filter is generally sized and arranged with a suitable density such that the draw of air therethrough is similar to a filter for a conventional tobacco cigarette.

In the substitute portion, denser material can be used such that the overall draw results in a pressure drop of air being drawn through the overall tubular casing which is approximately between 100 and 300 millimeters of water.

Figure 4:
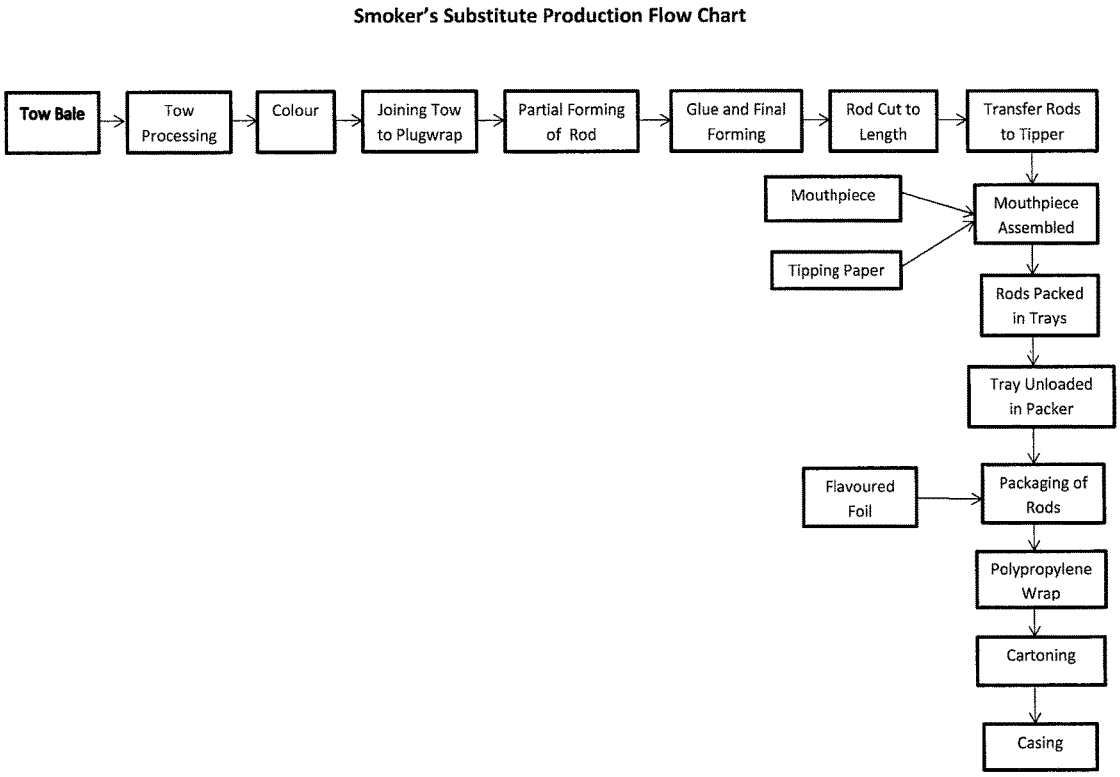
FIG. 4 is a schematic representation of process for manufacturing the cigarette substitute device.

The process of manufacture for the substitute cigarette devices 10 when using cellulose acetate as the porous material will now be described with reference to FIG. 4.

Initially, cellulose acetate tow is drawn from a bale and the tow is processed by widening of the tow band using high volume, low pressure air. Deregistering and separating of the crimp in the acetate tow band is accomplished by means of variable ratio roller assemblies. Uniform color is then provided throughout the cellulose acetate tow band using red and brown coloring agents to represent combusting tobacco such that the exposed second porous material at the second end 14 of the substitute cigarette device once completed has the appearance of a conventional tobacco cigarette which is lit.

A plug wrapping paper is then applied to the acetate tow band in which the plug wrap paper forms the substitute portion of the tubular casing in the completed substitute cigarette device. The plug wrap is applied by partially forming the acetate into a circular rod structure followed by applying seam glue to one edge of the plug wrap paper so that the paper can be sealed in the shape of a continuous rod during a final forming step. The continuous rods are then cut to length, for example 63 (king size) millimeters, and then transferred to a tipping machine.

Mouthpieces are provided which are manufactured according to conventional cigarette filter manufacturing techniques by providing a separate draw of cellulose acetate tow from a different bale. The cellulose acetate is processed with a respective wrap paper to form a 20 millimeter length cellulose acetate plug wrapped with paper forming the filter portion of the tubular casing. The mouthpiece is assembled to the end of the acetate rods that have been cut to length to form the respective substitute portions, using the tipping paper. The tipping paper overlaps the seam between the filter portion of the tubular casing and the substitute portion of the tubular casing. Adhesive is applied to the inner surface of the tipping paper and a sweet coating applied to the outer surface of the tipping paper prior to wrapping. The total length of the assembled substitute cigarette device is approximately 83 millimeters (king size) for example.

The finished substitute cigarette devices in the form of rod-like structures are packed in trays and the flavored foil forming the inner wrap or inner packaging material is then wrapped about the respective packaged rods from the trays which are unloaded into a packaging machine. The packaging machine inserts the grouped cigarette devices wrapped in flavored foil into respective outer packages 30 using a hinge lid packing machine similar to packaging of conventional tobacco cigarettes. Subsequent to loading of the trays of cigarettes and the flavor infused aluminum foil into the hinge lid packing machine, the substitute cigarette devices are packaged in groups of 20 within the respective packages. The foil wrap 28 forms inner packaging material and the hinged lid cardboard forms the outer package 30. Each package 30 is then wrapped with a polypropylene wrapper to preserve flavor and freshness. Groups of 10 packages are then collated and sealed within respective cartons, and 40 cartons are inserted into each case. Each box will contain the four flavors of Smoker's Substitute. Single flavors will be boxed in 25 carton containers. All boxes will be white with visible graphics on the boxes. Flavors will include Full Flavor (tobacco flavor), Cherry, Citrus, and Menthol.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A plurality of cigarette substitute devices for non-combustion use in combination with an outer package having a hollow interior receiving the plurality of cigarette substitute devices therein, each substitute cigarette device comprising:

an elongated tubular casing having a length extending in a longitudinal direction between a first end and a second end of the device;

a filter portion consisting of a first porous material occupying the tubular casing in proximity to the first end, the first porous material being selected from the list consisting of cellulose acetate and crimped paper;

a substitute portion consisting of a second porous material fully occupying the tubular casing between the filter portion and the second end, the second porous material being selected from the list consisting of cellulose acetate and crimped paper; and a flavouring agent which is arranged to release vapors;

the second porous material having a density which is greater than a density of the first porous material;

the first and second porous materials collectively fully occupying the tubular casing along the length thereof between the first end and the second end of the device;

the densities of the first and second porous materials being suitable to readily permit air to be drawn through the tubular casing in response to suction supplied by a user such that an overall pressure drop in air drawn through both the first and second porous materials of the tubular casing in response to suction supplied by a user is between 100 and 300 millimeters of water; and the flavouring agent being applied in an effective amount to the device such that vapors released from the flavouring agent impart a taste to said air drawn through the tubular casing;

wherein the plurality of cigarette substitute devices are supported in parallel to one another in a bundle within the outer package; and wherein the length of the cigarette substitute devices fully occupy a corresponding interior length of the outer package in the longitudinal direction of the tubular casings of the cigarette substitute devices.

2. The devices according to claim 1 wherein the first porous material consists of cellulose acetate.

3. The devices according to claim 2 wherein the cellulose acetate of the filter portion has a denier of approximately 3.0 per filament.

4. The devices according to claim 2 wherein the cellulose acetate of the filter portion has a total denier of approximately 30,000.

5. The devices according to claim 1 wherein the second porous material consists of cellulose acetate.

6. The devices according to claim 5 wherein the cellulose acetate of the substitute portion has a denier greater than 4.0 per filament.

7. The devices according to claim 6 wherein the cellulose acetate of the substitute portion has a denier of approximately 5.0 per filament.

8. The devices according to claim 5 wherein the cellulose acetate of the substitute portion has a total denier which is greater than 30,000.

9. The devices according to claim 8 wherein the cellulose acetate of the substitute portion has a total denier of approximately 39,000.

10. The devices according to claim 1 wherein the second porous material is coloured so as to be representative of combusting tobacco.

11. The devices according to claim 1 wherein the tubular casing includes a tipping paper wrapped about the filter portion which includes a consumable confection coating thereon.

12. The devices according to claim 1 wherein the flavoring agent is evenly dispersed throughout the first and second porous materials.

13. The devices according to claim 1 wherein the outer package further comprises a flavoring agent applied to an interior surface of packaging materials within the outer package so as to be arranged to impart flavoring to the plurality of cigarette substitute devices.

14. The devices according to claim 13 wherein the packaging materials include a foil wrapper having a paper lining defining said interior surface, the flavoring agent being applied to the paper lining.

15. The devices according to claim 1 wherein the first porous material of the filter portion consists of crimped paper.

16. The devices according to claim 1 wherein the second porous material of the substitute portion consists of crimped paper.

17. A plurality of cigarette substitute devices for non-combustion use in combination with an outer package having a hollow interior receiving the plurality of cigarette substitute devices therein, each substitute cigarette device comprising:

an elongated tubular casing having a length extending in a longitudinal direction between a first end and a second end of the device;

a filter portion consisting of a first porous material occupying the tubular casing in proximity to the first end;

a substitute portion consisting of a second porous material fully occupying the tubular casing between the filter portion and the second end; and a flavouring agent which is arranged to release vapors being applied in an effective amount to the device such that vapors released from the flavouring agent impart a taste to air drawn through the tubular casing;

the plurality of cigarette substitute devices being supported in parallel to one another in a bundle within the outer package;

the length of the cigarette substitute devices fully occupying a corresponding interior length of the outer package in the longitudinal direction of the tubular casings of the cigarette substitute devices;

the first and second porous materials collectively fully occupying the tubular casing along the length thereof between the first end and the second end of the device;

the substitute portion being greater in length than the filter portion;

the first porous material consisting of cellulose acetate, having a denier of approximately 3.0 per filament and a total denier of approximately 30,000; and the second porous material consisting of cellulose acetate, having a denier of greater than 4.0 per filament and a total denier of approximately 39,000;

whereby the densities of the first and second porous materials are suitable to readily permit air to be drawn through the tubular casing in response to suction supplied by a user such that an overall pressure drop in air drawn through both the first and second porous materials of the tubular casing in response to suction supplied by a user is between 100 and 300 millimeters of water.

* * * * *